US007219632B2

(12) United States Patent
Yamazaki

(10) Patent No.: US 7,219,632 B2
(45) Date of Patent: May 22, 2007

(54) NARROW ANGLE V-TYPE ENGINE

(75) Inventor: Masahiro Yamazaki, Yamagata (JP)

(73) Assignee: YGK Co., Ltd., Yamagata-shi (JP)

( * ) Notice: Subject to any disclaimer, the term of this patent is extended or adjusted under 35 U.S.C. 154(b) by 0 days.

(21) Appl. No.: 10/529,944

(22) PCT Filed: Oct. 8, 2003

(86) PCT No.: PCT/JP03/12892

§ 371 (c)(1),
(2), (4) Date: Apr. 1, 2005

(87) PCT Pub. No.: WO2004/033883

PCT Pub. Date: Apr. 22, 2004

(65) Prior Publication Data

US 2006/0011153 A1 Jan. 19, 2006

(30) Foreign Application Priority Data

Oct. 11, 2002 (JP) ..... 2002-298686

(51) Int. Cl.
*F02B 75/22* (2006.01)
*F02F 1/42* (2006.01)

(52) U.S. Cl. ..... 123/54.4; 123/193.5; 123/197.4

(58) Field of Classification Search ..... 123/54.4–54.8, 123/197.4, 193.5
See application file for complete search history.

(56) References Cited

U.S. PATENT DOCUMENTS 1,531,430 A * 3/1925 Wrentmore ..... 123/54.7
3,626,815 A 12/1971 Fingeroot et al.
4,194,469 A * 3/1980 Kruger ..... 123/54.6
4,319,548 A * 3/1982 Kruger ..... 123/54.4

FOREIGN PATENT DOCUMENTS

| | | | |
|---|---|---|---|
| FR | 2618183 A | * | 1/1989 |
| FR | 2618851 | | 2/1989 |
| JP | 61218718 | | 9/1986 |
| JP | 62-228645 | | 10/1987 |
| JP | 63-143332 | | 6/1988 |
| JP | 9-250408 | | 9/1997 |
| JP | 10-121980 | | 5/1998 |
| JP | 2001-200728 | | 7/2001 |

* cited by examiner

*Primary Examiner*—Noah P. Kamen
(74) *Attorney, Agent, or Firm*—Rabin & Berdo, P.C.

(57) ABSTRACT

A V-engine having a plurality of cylinders (2) arranged alternately in two banks comprises a combustion chamber provided for each of the cylinders (2), an intake port (20) which connects the combustion chamber to an intake manifold (50), and an exhaust port (30) which connects the combustion chamber to an exhaust manifold (70). The intake ports (20) of the two banks are all configured so as to pass through one of the banks, and the exhaust ports (30) of the two banks are all configured so as to pass through the other bank. The angle formed by the two banks is set to eight degrees or less.

6 Claims, 7 Drawing Sheets

NARROW ANGLE V-TYPE ENGINE

TECHNICAL FIELD

This invention relates to a V-engine, and more particularly to a narrow angle V-engine having a small bank angle.

BACKGROUND OF THE INVENTION

The bank angle of a V-engine is determined according to the number of cylinders. In a four-cylinder V-engine, the bank angle is often set to ninety degrees, and in a six-cylinder V-engine, the bank angle is often set to one hundred and twenty degrees. JP10-121980A, published by the Japan Patent Office in 1998, proposes an engine in which the bank angle is reduced to thirty degrees.

SUMMARY OF THE INVENTION

However, the aforementioned prior art engine is constituted such that intake air is supplied from the upper side of the cylinder head, causing an increase in the overall height of the engine. Further, exhaust gas is discharged from both sides of the engine in each bank, causing a reduction in the exhaust gas temperature which leads to a reduction in the conversion efficiency of the catalyst.

Regarding this point, gathering together the intake ports and exhaust ports respectively on one side of the engine has been considered, but in the aforementioned engine, the bank angle is a large thirty degrees, and hence the inflow angle of the intake port (the angle formed by the tangent of the centerline of the intake port directly before the valve seat and the centerline of the cylinder) differs between the left and right banks, causing another problem in that gas flow within the cylinder becomes uneven, leading to irregularities in combustion. Engines with a bank angle of fifteen degrees also exist, but gas flow is still uneven, and stable combustion cannot be obtained.

An object of this invention is to improve the conversion efficiency of exhaust gas while suppressing the height of the engine by arranging the intake ports and exhaust ports respectively on one side of the engine, and also to realize even combustion by making the gas flow substantially identical in the left and right banks.

According to this invention, a V-engine having a plurality of cylinders arranged alternately in two banks comprises a combustion chamber provided in each cylinder, an intake port which connects the combustion chamber to an intake manifold, and an exhaust port which connects the combustion chamber to an exhaust manifold. All of the intake ports of the two banks are configured so as to pass through one of the banks, and all of the exhaust ports of the two banks are configured so as to pass through the other bank. The angle formed by the two banks is set to eight degrees or less.

Hence according to this invention, the intake ports of the two banks are gathered together on one bank in order to suppress the height of the engine, and the exhaust ports of the two banks are gathered together in the other bank in order to increase the conversion efficiency of the catalyst (see FIGS. 3 and 4). By setting the bank angle to eight degrees or less, a uniform tumble ratio can be attained in the two banks (see FIG. 9), and even combustion can be realized.

An embodiment and advantages of this invention will be described in detail below with reference to the attached drawings.

DESCRIPTION OF THE PREFERRED EMBODIMENTS

In the following description, for the sake of convenience, the left side of the engine when the engine is seen from the front will be described as the left bank, and the right side will be described as the right bank.

Figure 1:
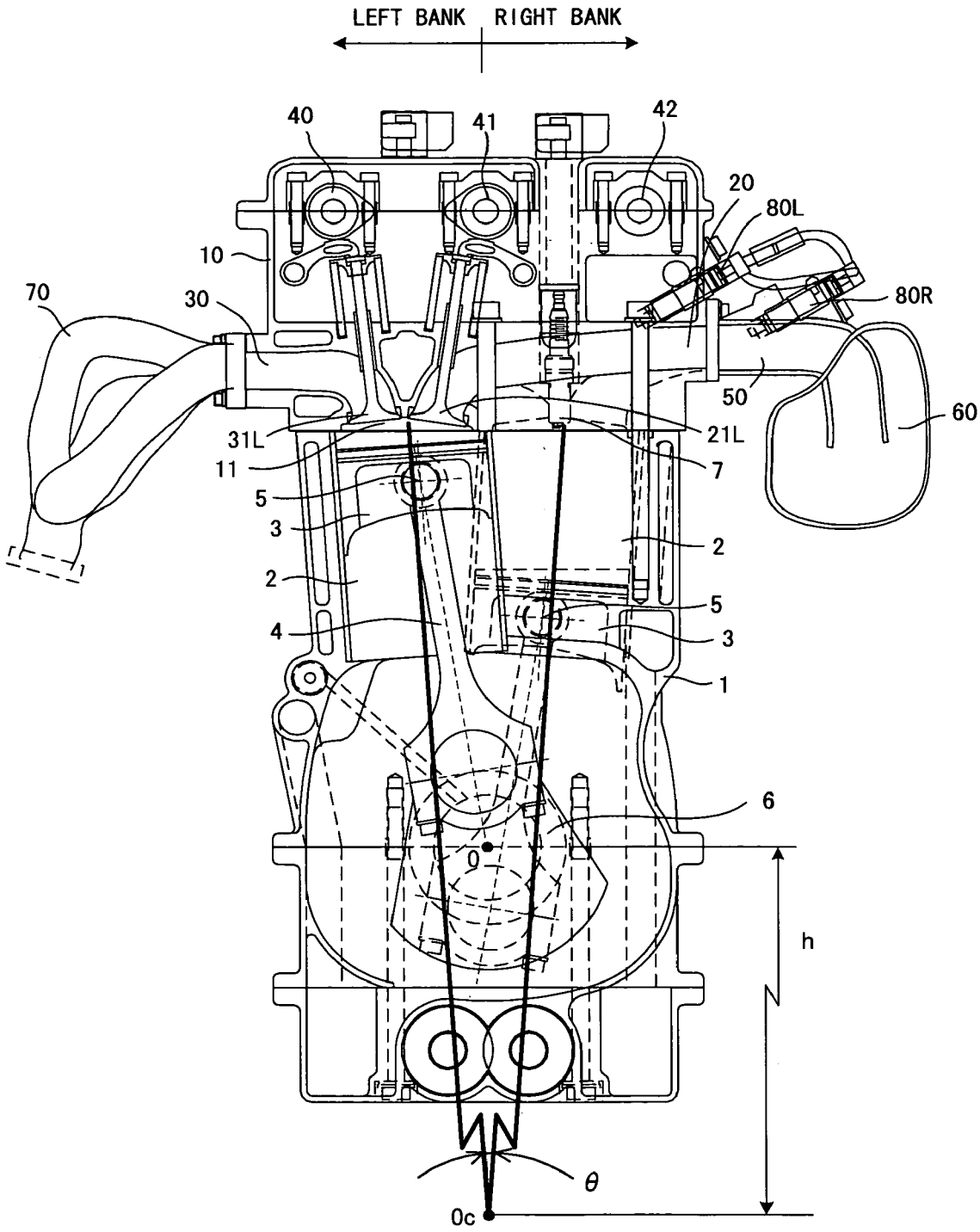
FIG. 1 is a schematic diagram of a narrow angle V-engine according to this invention.
Figure 2:
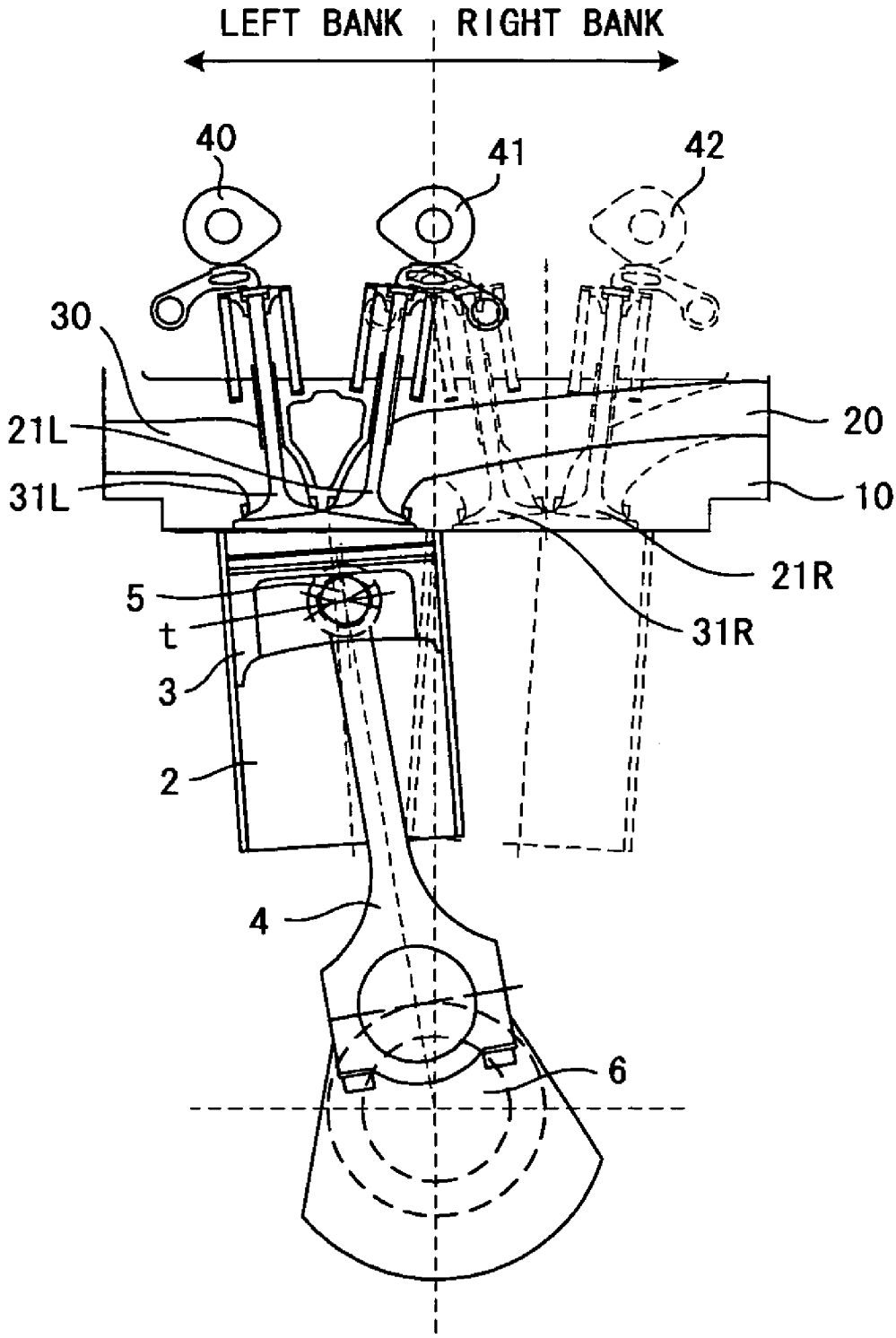
FIG. 2 is a view illustrating the offset of a piston pin.

FIGS. 1 and 2 show the constitution of a four cylinder V-engine according to this invention. The left and right banks of a cylinder block 1 are formed with a plurality of cylinders 2, each opening onto the upper face of the cylinder block side by side in the longitudinal direction of the engine. A piston 3 is slidably installed in each of the cylinders 2. The piston 3 is swingably connected to the upper end of a con-rod 4 via a piston pin 5, and the lower portion of the con-rod 4 is connected to a crankshaft 6 via a crank pin. The reciprocating motion of the piston 3 is converted into a rotary motion by the crankshaft 6, and this rotary motion is transmitted to a driving wheel via a transmission, final reduction gear, and drive shaft not shown in the drawing.

When the engine is seen from the front, the con-rod 4 and crankshaft 6 are not connected in a position Oc at which the centerline of the left bank cylinders and the centerline of the right bank cylinders intersect, but instead are connected in a position O, which is offset upward in the engine by h from the position Oc at which the centerlines intersect. By offsetting the crankshaft 6 upward in this manner, the height of the engine is suppressed.

Further, as shown in FIG. 2, the piston 3 and con-rod 4 are not connected at the central axis of the cylinder 2 and piston 3, but instead are connected at a location which is offset toward the central side of the engine, that is in the diametrical direction of the cylinder 2 and piston 3 from the central axis of the cylinder 2 and piston 3 (an orthogonal direction to the central axis of the cylinder 2 and piston 3) by t. The offset amount t is set to approximately 5% of the cylinder diameter, for example. When the crankshaft 6 is offset upward, the force (side force) from the piston 3 which acts on the inner wall of the cylinder 2 when the piston 3 slides increases, but by offsetting the piston pin 5 toward the central side of the engine in this manner, this force can be reduced. It should be noted that in this engine, the L/R ratio of the con-rod 4 is made larger than a conventional L/R ratio in order to further reduce the side force.

The piston 3 is formed such that the crown face thereof is parallel to the upper face of the cylinder block 1, and such that the skirt portion thereof toward the outside of the cylinder block 1 (to be referred to as the thrust side below) is longer in the axial direction of the cylinder 2 and piston 3 than the skirt portion toward the center of the engine.

By making the crown face of the piston 3 parallel with the upper face of the cylinder block 1, a flame propagates vigorously from the flame kernel that is generated in the vicinity of the spark gap of a spark plug 7 and heat becomes less likely to escape, and hence rapid combustion is realized. In other words, by making the crown face of the piston 3 parallel with the upper face of the cylinder block 1, the radial direction component of the speed of the flame which propagates radially can be increased. Moreover, the combustion chamber is made compact while the surface area of the piston crown face is reduced, and thus the thermal energy that is generated in the combustion chamber can be prevented from escaping from the cylinder block 1 and the crown face of the piston 3. Also, by making the combustion chamber compact, the compression ratio can be increased.

The reason for lengthening the skirt portion on the thrust side is related to the fact that by offsetting the position of the piston pin 5, thrust is reduced such that when the piston 3 slides, momentum is generated around the piston pin 5 and the piston 3 attempts to rotate at an incline. By lengthening the skirt portion of the piston 3 on the thrust side, the piston 3 is supported such that the orientation of the piston 3 during reciprocating motion can be stabilized. Further, by offsetting the crankshaft 6 upward, the side force which acts on the inner wall of the cylinder increases, and hence the surface area of the skirt portion is increased, thereby reducing surface pressure. Lengthening the skirt portion is also effective in reducing the banging sound (slapping sound) of the piston 3.

It should be noted that only the skirt portion on the thrust side is lengthened, and the skirt portion on the inner side remains as is. Hence even when the piston 3 falls to bottom dead center, the piston 3 does not interfere with the rotary tracks of the counterweight.

Further, the left bank cylinders and right bank cylinders of the cylinders 2 are disposed alternately in zigzag fashion from the front of the engine, and are disposed alternately within the left and right banks so as not to be disposed consecutively in the same bank, and such that no plurality of cylinders exists at an equal distance from the front end of the engine. Further, an angle θ (to be referred to as the bank angle hereafter) formed by the centerline of the left bank cylinders and the centerline of the right bank cylinders when the engine is seen from the front is set to eight degrees or less (preferably to eight degrees). By setting the bank angle at eight degrees or less, the tumble ratio becomes substantially equal in the left and right banks, and thus stable combustion can be realized. This point will be described in detail later.

A single cylinder head 10 is connected to the upper face of the cylinder block 1. The reason for being able to provide a single cylinder head for both the left and right banks in this manner is that the bank angle is small. Since the cylinder head is shared between the left and right banks, the rigidity of the engine can be maintained at a high level.

A concave portion 11 which forms a part of the respective combustion chambers is formed in each of the positions corresponding to the upper side opening of the cylinders 2 on the lower face of the cylinder head 10. An intake port 20 and exhaust port 30 are opened in the concave portion 11, and the spark gap of the spark plug 7 protrudes therefrom.

An intake valve 21L and an exhaust valve 31L are provided in the combustion chamber of the left bank for blocking communication between the intake port 20 and exhaust port 30, and an intake valve 21R and an exhaust valve 31R are provided similarly in the combustion chamber of the right bank. The left bank exhaust valve 31L, the left bank intake valve 21L and right bank exhaust valve 31R, and the right bank intake valve 21R are open/close driven by a left side camshaft 40, a central camshaft 41, and a right side camshaft 42 respectively. The intake port 20 is connected to a box-form collector 60, into which air is introduced, through an intake manifold 50, and the exhaust port 30 is connected to an exhaust pipe not shown in the drawing through an exhaust manifold 70.

Figure 3:
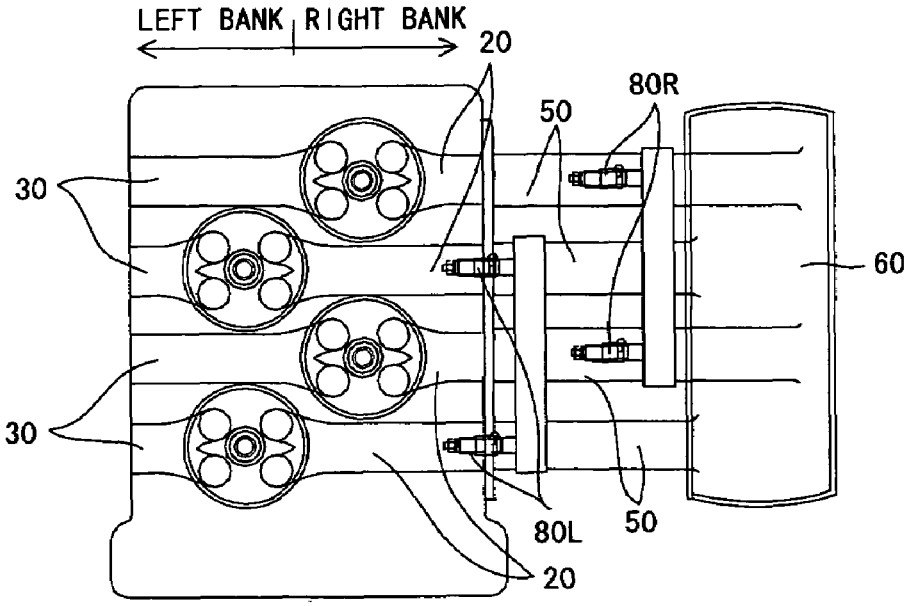
FIG. 3 is a view illustrating the constitution of an intake side of the engine.
Figure 4:
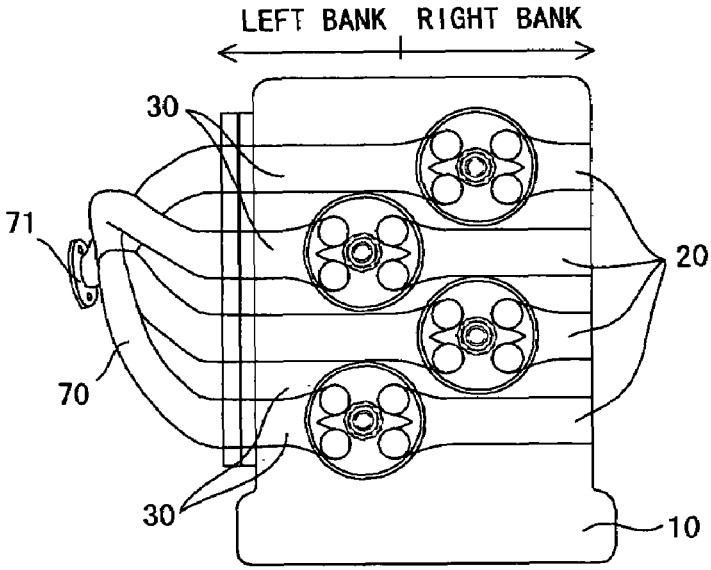
FIG. 4 is a view illustrating the constitution of an exhaust side of the engine.
Figure 5:
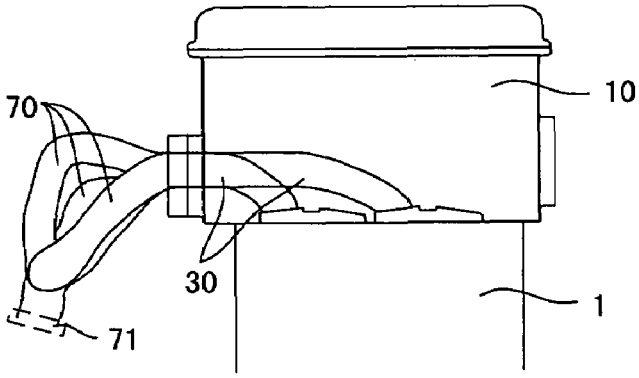
FIG. 5 is a view illustrating the constitution of the exhaust side of the engine.

As shown in FIGS. 3 to 5, in the engine described above, the intake ports 20 and exhaust ports 30 are gathered together such that all of the intake ports 20 pass through the right bank and all of the exhaust ports 30 pass through the left bank, and the length of the intake ports 20 and exhaust ports 30 differ between the left bank and right bank.

Regarding the intake side, as shown in FIG. 3, by varying the pipe length of the intake manifold 50 according to the length of the intake port 20, differences in the length of the intake ports 20 in the left and right banks are compensated for. More specifically, the intake manifold 50 connected to the intake ports 20 of the right bank, which are shorter than those of the left bank, is extended to the interior of the collector 60 such that the distance from the combustion chamber through the intake port 20 to the opening of the intake manifold is equal in all of the combustion chambers.

Figure 6:
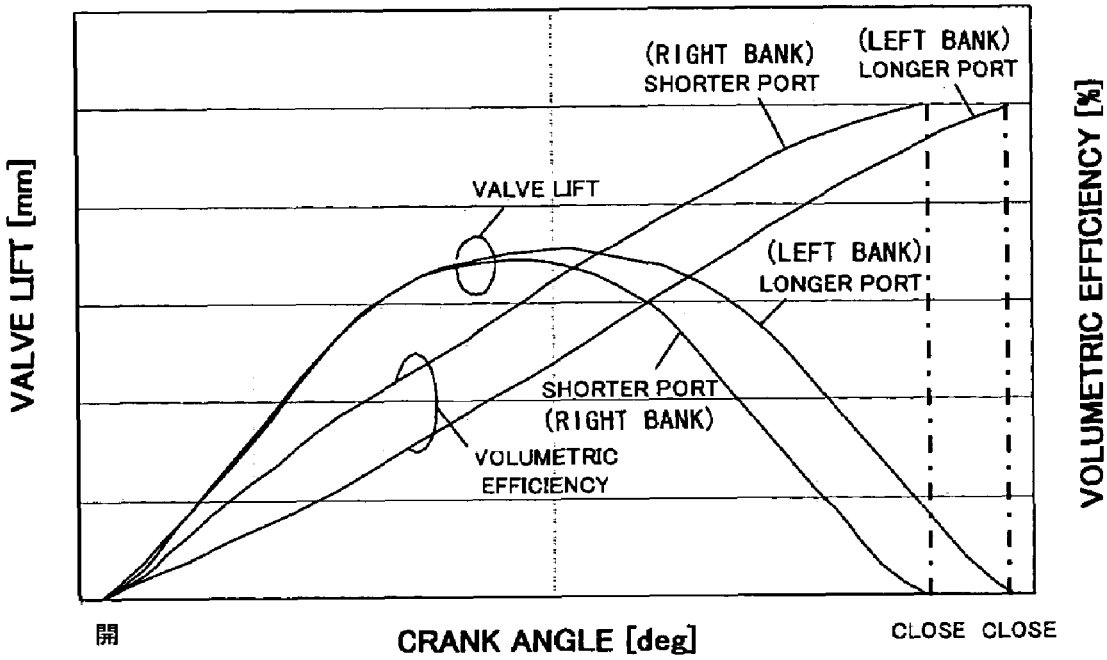
FIG. 6 is a diagram illustrating the valve timing of an intake valve.

Alternatively, as shown in FIG. 6, differences in the length of the intake ports 20 of the left and right banks may be compensated for by varying the timing at which the intake valve is closed between the left and right banks. In this case, if the timing at which the intake valve is closed in the left bank, which has longer intake ports 20 than the right bank, is delayed beyond the timing in the right bank, volumetric efficiency can be made equal in the left and right banks.

Regarding the exhaust side, as shown in FIGS. 4 and 5, differences in the length of the exhaust ports 30 of the left and right banks are compensated for by varying the length of the branch portions of the exhaust manifold 70 according to the length of the exhaust ports 30. In the left bank, which has shorter exhaust ports 30 than the right bank, the curvature of the exhaust manifold 70 is increased such that the branch portion is lengthened, and thus the pipe length from the combustion chamber through the exhaust port 30 to a confluence portion 71 of the exhaust manifold 70 is set equally in all of the combustion chambers.

Further, as shown in FIG. 3, injectors 80R, 80L for injecting fuel are provided on the intake side, and the attachment position of the injectors 80R, 80L are different for the left and right banks. More specifically, the fuel injector 80L, which injects fuel into the air that is supplied to the combustion chambers of the left bank, is provided in the part of the intake port 20 which communicates with the combustion chambers of the left bank, whereas the fuel injector 80R, which injects fuel into the air that is supplied to the combustion chambers of the right bank, is provided in the part of the intake manifold 50 which communicates with the combustion chambers of the right bank. The reason for varying the attachment positions of the injectors of the left bank and right bank is to equalize the distance from the fuel injection position (the position of the nozzle of the injectors 80R, 80L) to the combustion chamber for all of the combustion chambers in the left bank and right bank. In so doing, the mixing condition of the air-fuel mixture is equalized such that irregularities in air-fuel mixing or deteriorations in output or fuel economy caused by uneven air and fuel distribution can be avoided.

By gathering together the intake ports 20 and exhaust ports 30 on the side of one bank respectively, exhaust gas can be gathered and caused to flow into the exhaust pipe while still hot, and the temperature of the exhaust gas which flows into the catalyst can be kept high. Thus the conversion efficiency of the catalyst can be improved. As a result, warm-up of the exhaust catalyst directly after start-up is precipitated, and exhaust gas purification efficiency can be improved when cold. Further, by equalizing the length from the combustion chamber to the confluence portion 71 of the exhaust manifold 70, decreases in exhaust efficiency can be reduced.

Figure 7:
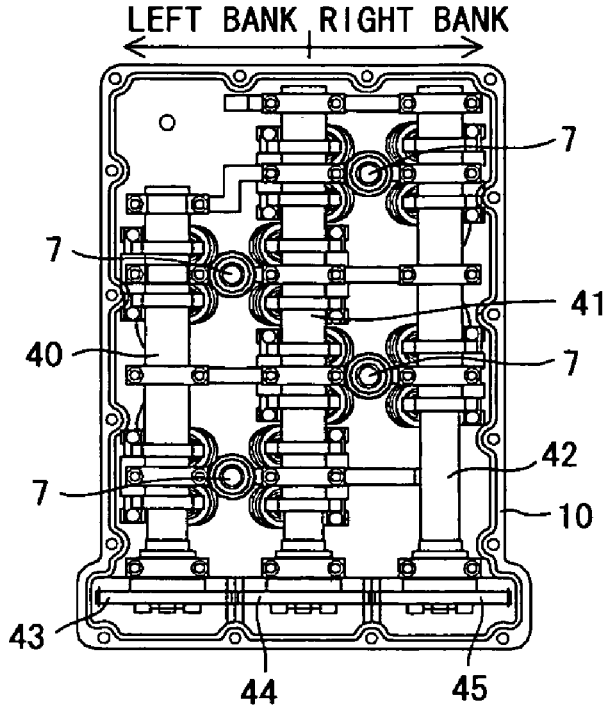
FIG. 7 is a view illustrating a cam mechanism of the engine.
Figure 8:
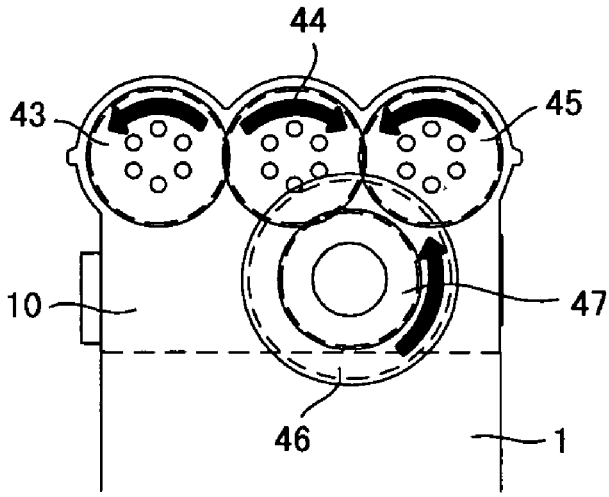
FIG. 8 is a view illustrating the cam mechanism of the engine.

FIGS. 7 and 8 show the cam constitution of the above engine. The three camshafts 40, 41, 42 are rotatably supported in the cylinder head 10, and cam gears 43, 44, 45 are provided on the respective end portions of the camshafts at the engine front end side. The intake valves 21R, 21L and exhaust valves 31R, 31L are driven by a cam face formed on the outer periphery of the three camshafts.

By reducing the bank angle to eight degrees or less, the distance between the cylinders on the left and right banks is narrowed, whereby a single cylinder head 10 can be provided for both the left and right banks, and the camshaft which drives the left bank intake valve 21L and the camshaft which drives the right bank exhaust valve 31R can be integrated. Hence, although the engine according to this invention is a DOHC V-engine, the number of camshafts therein can be reduced to three.

To describe the cam driving mechanism, the cam gears 43, 44, 45 have an identical diameter, the cam gear 43 meshing with the cam gear 44, and the cam gear 44 meshing with the cam gear 45. The cam gear 44 of the central camshaft 41 also meshes with an idler gear 47 which rotates integrally with a cam sprocket 46. The idler gear 47 also has an identical diameter to the cam gears 43, 44, 45. A chain is hung around the cam sprocket 46 and a crank sprocket (not shown) which rotates integrally with the crankshaft 6, and thus the rotation of the crankshaft 6 is transmitted to the cam gears 43, 44, 45 through the crank sprocket and cam sprocket 46, whereby the camshafts 40, 41, 42 are driven to rotate as shown by the arrow in the drawing. It should be noted that the cam sprocket 46 rotates at half the speed of the crank sprocket.

When synchronization between the cam gears is attempted using only the chain, the chain stretches during high-speed rotation, and hence it is difficult to achieve accurate cam driving in synchronization with the rotation of the crankshaft. However, if driving is performed using the above gears and chain simultaneously, accurate synchronization between the cam gears can be obtained. Moreover, in so doing the cam driving mechanism can be made compact and the number of components can be reduced. It should be noted that here, the crank sprocket and the cam sprocket 46 are driven by a chain provided therebetween, but may be driven by a gear provided therebetween.

Figure 9:
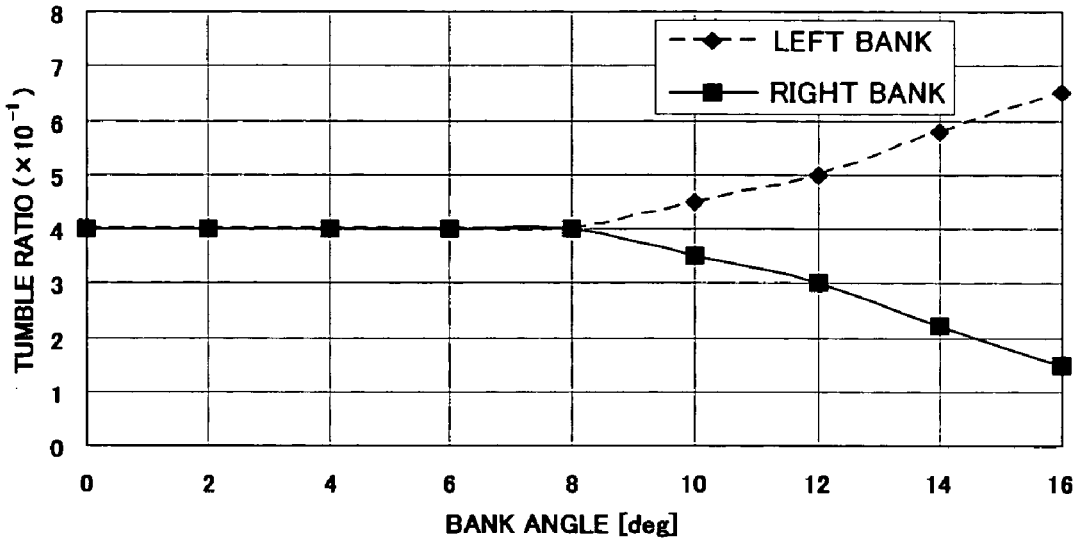
FIG. 9 is a diagram illustrating the relationship between the bank angle and the tumble ratio.

FIG. 9 shows the relationship between the bank angle and the tumble ratio. The tumble ratio is the ratio of the average intake air speed and the speed of the tumble flow. To realize even combustion, the tumble ratio must be equalized in the left and right banks.

In a conventional V-engine, when the intake port and exhaust port are gathered on one side of the engine respectively, the air inflow angle in one of the banks (the angle formed between the tangent of the centerline of the intake air port directly before the valve seat, and the centerline of the cylinder) increases such that the vertical-direction gas flow generated within the cylinder is obstructed. As a result, a difference in the tumble ratios of the left and right banks arises, causing uneven combustion. Furthermore, when the inflow angle increases, air resistance increases.

In the engine according to this invention, however, the bank angle is set to eight degrees or less, and thus the ratio of the vertical-direction swirl generated when air flows into the cylinders 2 from each of the intake valves, or in other words the tumble ratio, is made substantially equal in the left and right banks such that combustion can be performed evenly in the left and right banks.

Hence, according to this invention, the gas flow through the cylinders of both banks causes fuel particles and air to mix well, as a result of which even combustion can be realized and combustion efficiency which is no different to a straight engine can be obtained even in a V-engine.

Figure 10:
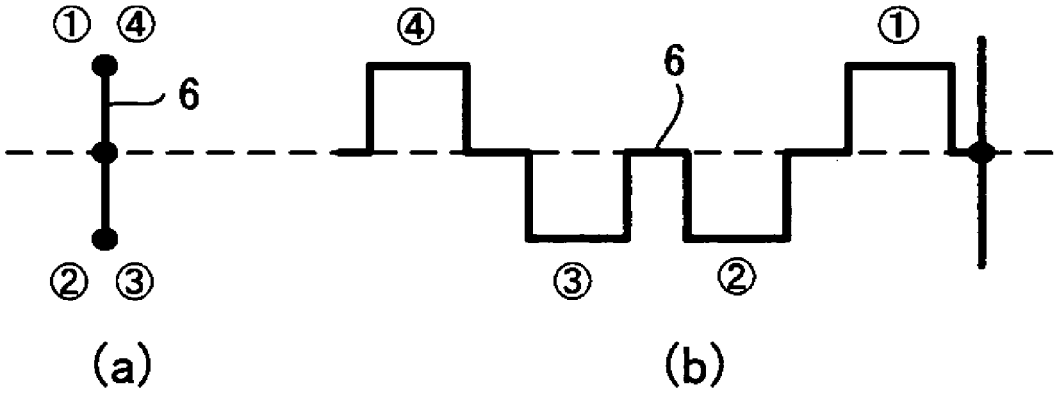
FIG. 10 is a view illustrating the form of a crankshaft.

Even when the bank angle is narrow, the combustion interval deviates between the left and right banks by an amount corresponding to the bank angle. However, when the bank angle is set to eight degrees or less as in this invention, the fact that the combustion interval is unequal can be virtually ignored, and the crankshaft 6 can be set on a single plane. In other words, as shown in (a) and (b) of FIG. 10, the crank pins for the first and fourth cylinders are in phase, and the crank pins for the second and third cylinders each have a 180° phase, thereby enabling all of the crank pins to be positioned on a single plane. By setting the crankshaft 6 on a single plane, manufacture of the crankshaft 6 is simplified and a reduction in costs can be achieved.

In the case of the engine in this invention, the engine can be regarded as the engine which is made by combining two-cylinder engines alternately such that the two combustion intervals become substantially equal. Constitutionally, the two-cylinder engines are balanced during the respective primary vibrations thereof, and no problems regarding vibration arise even when the engines are combined. Hence it may be presumed that no problems regarding vibration would arise in the above engine.

An embodiment of this invention was described above, but the embodiment described above merely illustrates one example of an engine to which this invention is applied, and does not purport to limit the technical scope of this invention.

For example, the embodiment described above uses a four-cylinder V-engine, but this invention may be applied to a V-engine having a different number of cylinders such as six or eight. Further, the number of cylinders is not limited to an even number, and may be an odd number. Also, two of the four-cylinder V-engines described above may be combined in parallel to form an eight-cylinder W engine.

INDUSTRIAL APPLICABILITY

This invention may be applied to a narrow angle V-engine having a small bank angle to reduce the size of the engine by suppressing the engine height, and to improve exhaust gas conversion efficiency and engine combustion efficiency.

The invention claimed is:

1. A narrow angle V-engine comprising:

a plurality of pistons (3);

a plurality of cylinders (2) arranged alternately in two adjacent banks, the pistons (3) being installed in the cylinders (2), the cylinders (2) having combustion chambers;

a plurality of intake manifolds (50);

a plurality of exhaust manifolds (70);

intake ports (20) connecting the combustion chambers to the intake manifolds (50);

exhaust ports (30) connecting the combustion chambers to the exhaust manifolds (70);

a crankshaft (6); and con-rods (4) which connect the pistons (2) and the crankshaft (6), wherein the intake ports (20) of the two banks are all configured so as to pass through one of the banks, the exhaust ports (30) of the two banks are all configured so as to pass through the other bank, and an angle formed by the two banks is set to eight degrees or less, and wherein the pistons (3) and the con-rods (4) are connected by piston pins (5), each piston pin (5) being offset further toward the center of the engine than a centerline of the respective piston (3) and the cylinder (2).

2. A narrow angle V-engine comprising:

a plurality of pistons (3);

a plurality of cylinders (2) arranged alternately in two adjacent banks, the pistons (3) being installed in the cylinders (2), the cylinders (2) having combustion chambers;

a plurality of intake manifolds (50);

a plurality of exhaust manifolds (70);

intake ports (20) connecting the combustion chambers to the intake manifolds (50);

exhaust ports (30) connecting the combustion chambers to the exhaust manifolds (70);

a crankshaft (6); and con-rods (4) which connect the pistons (2) and the crankshaft (6), wherein the intake ports (20) of the two banks are all configured so as to pass through one of the banks, the exhaust ports (30) of the two banks are all configured so as to pass through the other bank, and an angle formed by the two banks is set to eight degrees or less, and wherein each piston (3) has a skirt portion toward the outside of the engine that is longer than a skirt portion thereof toward the center of the engine.

3. A narrow angle V-engine comprising:

a plurality of pistons (3);

a plurality of cylinders (2) arranged alternately in two adjacent banks, the pistons (3) being installed in the cylinders (2), the cylinders (2) having combustion chambers;

a plurality of intake manifolds (50);

a plurality of exhaust manifolds (70);

intake ports (20) connecting the combustion chambers to the intake manifolds (50);

exhaust ports (30) connecting the combustion chambers to the exhaust manifolds (70);

a crankshaft (6); and con-rods (4) which connect the pistons (2) and the crankshaft (6); and a collector (60) which communicates with the intake manifolds (50), and into which the ends of the intake manifolds (50) that are opposite to the combustion chambers open, the collector being disposed closer to one of the banks than the other wherein the intake ports (20) of the two banks are all configured so as to pass through one of the banks, the exhaust ports (30) of the two banks are all configured so as to pass through the other bank, and an angle formed by the two banks is set to eight degrees or less, and wherein the intake manifolds (50) which are connected to the intake port (20) of cylinders in the closer bank extend to the interior of the collector (60) and open into the interior of the collector (60), whereby the lengths of the intake manifolds (50) are equalized for all of the combustion chambers.

4. A narrow angle V-engine comprising:

a plurality of pistons (3);

a plurality of cylinders (2) arranged alternately in two adjacent banks, the pistons (3) being installed in the cylinders (2), the cylinders (2) having combustion chambers;

a plurality of intake manifolds (50);

a plurality of exhaust manifolds (70);

intake ports (20) connecting the combustion chambers to the intake manifolds (50);

exhaust ports (30) connecting the combustion chambers to the exhaust manifolds (70);

a crankshaft (6); and con-rods (4) which connect the pistons (2) and the crankshaft (6);

a collector (60) which communicates with the intake manifolds (50), the collector being disposed closer to one of the banks than the other; and valves to open and close the intake ports;

wherein the intake ports (20) of the two banks are all configured so as to pass through one of the banks, the exhaust ports (30) of the two banks are all configured so as to pass through the other bank, and an angle formed by the two banks is set to eight degrees or less, and wherein a timing for closing the intake valves of the intake ports (20) of the cylinders in the bank farthest from the collector (60) is delayed beyond a timing for closing the intake valves of the cylinders in the bank closest to the collector (60), whereby the intake efficiency of the two banks is equalized.

5. A narrow angle V-engine comprising:

a plurality of pistons (3);

a plurality of cylinders (2) arranged alternately in two adjacent banks, the pistons (3) being installed in the cylinders (2), the cylinders (2) having combustion chambers;

a plurality of intake manifolds (50);

a plurality of exhaust manifolds (70);

intake ports (20) connecting the combustion chambers to the intake manifolds (50);

exhaust ports (30) connecting the combustion chambers to the exhaust manifolds (70);

a crankshaft (6); and con-rods (4) which connect the pistons (2) and the crankshaft (6);

a collector (60) which communicates with the intake manifolds (50), the collector being disposed closer to one of the banks than the other; and injectors (80R, 80L) for injecting fuel into the air in the two banks respectively, wherein the intake ports (20) of the two banks are all configured so as to pass through one of the banks, the exhaust ports (30) of the two banks are all configured so as to pass through the other bank, and an angle formed by the two banks is set to eight degrees or less, and wherein the attachment positions of the injectors (80R, 80L) are varied between the two banks to equalize the distance from the combustion chambers to fuel injection positions for all of the combustion chambers.

6. A narrow angle V-engine comprising:

a plurality of pistons (3);

a plurality of cylinders (2) arranged alternately in two adjacent banks, the pistons (3) being installed in the cylinders (2), the cylinders (2) having combustion chambers;

a plurality of intake manifolds (50);

a plurality of exhaust manifolds (70);

intake ports (20) connecting the combustion chambers to the intake manifolds (50);

exhaust ports (30) connecting the combustion chambers to the exhaust manifolds (70);

a crankshaft (6); and con-rods (4) which connect the pistons (2) and the crankshaft (6);

a collector (60) which communicates with the intake manifolds (50), the collector being disposed closer to one of the banks than the other;

wherein the intake ports (20) of the two banks are all configured so as to pass through one of the banks, the exhaust ports (30) of the two banks are all configured so as to pass through the other bank, and an angle formed by the two banks is set to eight degrees or less, and wherein the lengths of branch portions of the exhaust manifolds (70) which are connected to the exhaust ports (30) of the cylinders in the bank farthest from the collector (60) are increased beyond the lengths of branch portions of the exhaust manifolds (70) which are connected to the exhaust ports (30) of the cylinders in the bank closest to the collector (60), whereby the distance from the combustion chambers to a confluence portion of the exhaust manifold (70) is equalized for all of the combustion chambers.

* * * * *